US006935075B2

(12) United States Patent
Sherman

(10) Patent No.: US 6,935,075 B2
(45) Date of Patent: Aug. 30, 2005

(54) TRIANGULAR STACKABLE BUILDING WALL MODULE AND METHOD

(76) Inventor: Brian James Sherman, 672 Beechwood St., Holland, MI (US) 49423

( * ) Notice: Subject to any disclaimer, the term of this patent is extended or adjusted under 35 U.S.C. 154(b) by 64 days.

(21) Appl. No.: 10/162,000

(22) Filed: Jun. 4, 2002

(65) Prior Publication Data

US 2003/0221376 A1 Dec. 4, 2003

(51) Int. Cl.[7] ..... E04H 1/00

(52) U.S. Cl. ..... 52/79.1; 52/79.3; 52/79.4; 446/108; 446/115; 446/116; 446/124; 446/125

(58) Field of Search ..... 52/79.1, 79.4, 52/284, 270, DIG. 10, 79.3; 446/102, 104, 108, 114, 115, 116, 120, 121, 124–5, 127–128

(56) References Cited

U.S. PATENT DOCUMENTS

| | | | | |
|---|---|---|---|---|
| 1,779,755 A | * | 10/1930 | Smith | |
| 2,082,792 A | | 6/1937 | Dean | 189/37 |
| 2,169,254 A | | 8/1939 | Kotreaty | 189/34 |
| 2,193,994 A | | 3/1940 | Weaver | 189/1 |
| 2,249,028 A | * | 7/1941 | Mulderink | |
| 2,718,289 A | | 9/1955 | Collins | 189/34 |
| 2,776,521 A | * | 1/1957 | Zimmerman | |
| 3,230,673 A | * | 1/1966 | Gersin | |
| 3,347,363 A | * | 10/1967 | Dykes et al. | |
| 3,660,952 A | * | 5/1972 | Wilson | 52/81 |
| 3,665,882 A | * | 5/1972 | Georgiev et al. | |
| 3,785,096 A | * | 1/1974 | Neuhardt | 52/79 |
| 3,913,285 A | * | 10/1975 | Helfrich | 52/64 |
| 3,950,912 A | | 4/1976 | Lundberg et al. | 52/727 |
| 4,821,471 A | * | 4/1989 | Stephens et al. | 52/81 |
| 4,918,899 A | | 4/1990 | Karytinos | 52/690 |
| 4,923,544 A | * | 5/1990 | Weisse | 156/153 |
| 5,129,204 A | | 7/1992 | Palumbo | 52/720 |
| 5,329,737 A | * | 7/1994 | Roberts et al. | 52/245 |
| 5,379,567 A | | 1/1995 | Vahey | 52/724 |
| 5,483,782 A | | 1/1996 | Hall | 52/730.1 |
| 5,642,594 A | | 7/1997 | Sucre et al. | 52/270 |
| 5,685,121 A | | 11/1997 | DeFrancesco et al. | 52/731.9 |
| 6,076,318 A | * | 6/2000 | Grimm et al. | 52/245 |
| 6,094,881 A | | 8/2000 | Lockwood | 52/731.2 |
| 6,152,797 A | * | 11/2000 | David | 446/115 |
| 6,282,849 B1 | * | 9/2001 | Tuczek | 52/81.1 |
| 6,295,785 B1 | * | 10/2001 | Herrmann | 52/745.08 |
| 6,609,336 B2 | * | 8/2003 | Matsubara | 52/79.12 |

FOREIGN PATENT DOCUMENTS

| | | |
|---|---|---|
| GB | WO88/05850 | 8/1988 |

* cited by examiner

*Primary Examiner*—Jeanette E. Chapman
(74) *Attorney, Agent, or Firm*—John J. Swartz

(57) ABSTRACT

A stackable building wall unit adapted to be stacked with a plurality of identical building wall units in a plane to form a wall comprising three rectangular panels each including inner and outer faces, a pair of spaced apart long edges, and a pair of spaced apart short edges joined to the short edges of the other two panels to form a triangular, stackable building wall unit which can be stacked with the exterior surfaces of the panels in abutting relation. The exterior face of at least one of the panels includes a female recess therein for receiving a complementally formed key to facilitate alignment and preclude relative shifting of the stacked units in a direction extending between said long edges between the long edges. The key may suitably comprise a complementally formed male projection extending outwardly from another panel of an abutting unit. One aspect of the invention contemplates a method of constructing a wall with triangularly shaped building units stacked in a plane with the exterior plane or surfaces in abutting relation. Transverse flanges are provided on the long edges.

48 Claims, 5 Drawing Sheets

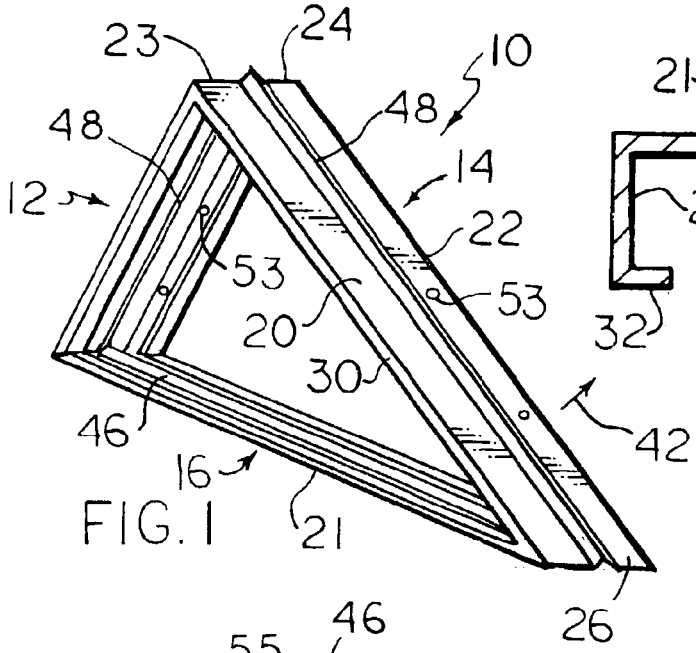
FIG. 1
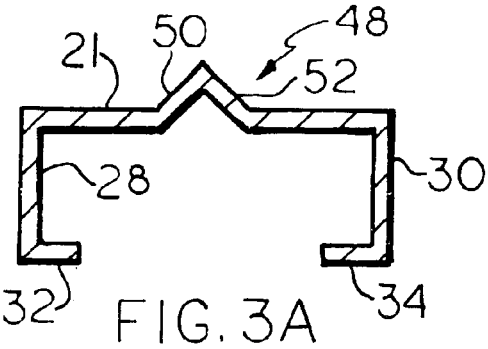
FIG. 3A
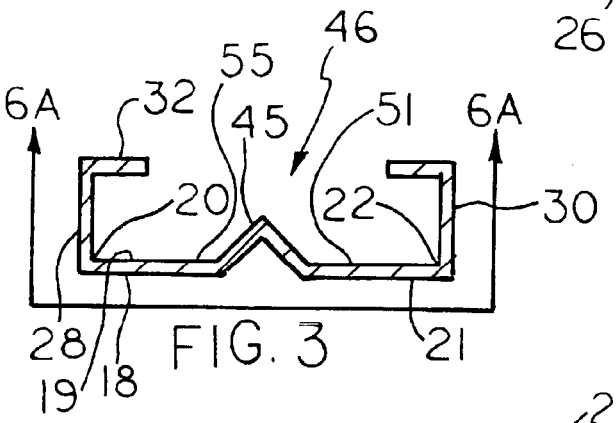
FIG. 3
FIG. 3B
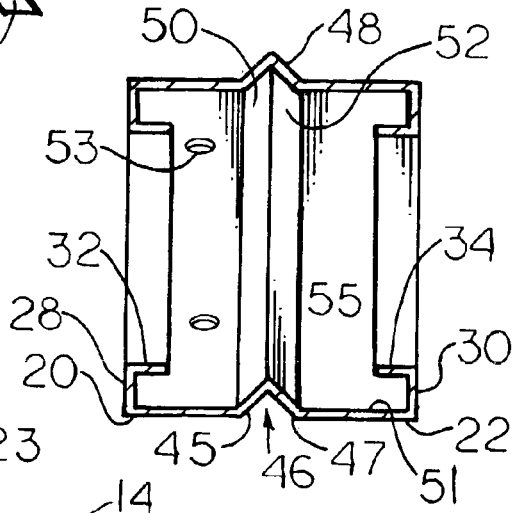
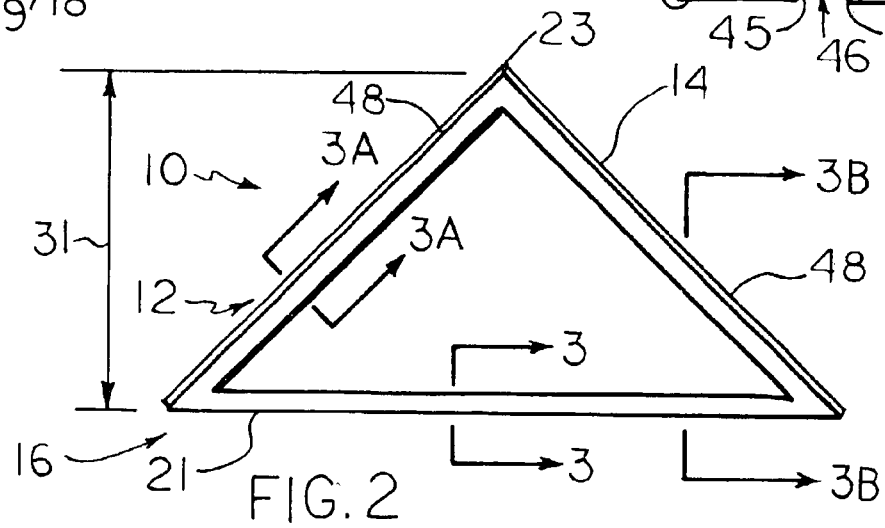
FIG. 2

TRIANGULAR STACKABLE BUILDING WALL MODULE AND METHOD

BACKGROUND OF THE INVENTION

1. Field of the Invention

This invention relates to the building construction industry and more particularly to a triangular stackable building wall module which can be stacked with a plurality of identically formed modules to form a building wall.

2. Description of Prior Art and Objects

Building walls are typically constructed with a frame comprising a pair of upper and lower parallel beams spanned by a plurality of vertical, horizontally spaced apart studs. The individual frame components are delivered to the construction site where they are assembled. Thereafter, holes are drilled through the studs and the horizontal beams for receipt of wiring and plumbing. The inner edges of the studs are covered by interior panels such as wall board and the exterior edges of the studs are covered by exterior sheeting or paneling and siding or brick. Frequently, insulation fills the voids between the studs.

One of the problems with this prior art construction is the relative ease with which a fire can spread upwardly between the studs in the elongate vertical cavities formed by the studs and the beams. Once a fire starts in the inside of the prior art wall, it is easy for an upward draft to quickly upwardly propel the fire to the upper portions of the building. Accordingly, it is an object of the present invention to provide a new and novel building unit which would inhibit the upward spreading of a fire in the wall of a building.

Another object of the present invention is to provide a building wall of the type described for encapsulating a fire in the wall and inhibiting it from quickly upwardly spreading from a lower portion of the building to the top of the building.

A still further object of the present invention is to provide a building wall unit of the type described which will restrict the open airways which extend between the sill plate and the header in a building.

Another object of the present invention is to provide a new and novel building wall unit which will increase the fire rating of a building compared to the conventional construction.

It is a further object of the present invention to provide a new and novel building wall module which will increase the fire rating of a building wall of predetermined dimensions compared to a prior art wall of similar dimensions by decreasing the upward spreading of an inadvertent fire in the wall.

Although prefabricated buildings are becoming more popular, a substantial number of buildings are still constructed with the individual wall components being delivered to the site and assembled at the site. This allows the building components to be subjected to the elements. This construction technique requires the workmen to work in the elements and is considered by many to be very inefficient. Accordingly, it is another object of the present invention to provide a new and novel building wall framing module which can either be shipped to the site for assembly at the site or can be easily used to prefabricate a wall section that is shipped to the site.

It is a further object of the present invention to provide a modular building unit of the type described which is self contained and includes provisions for the pre-installation and prefabrication of the insulation, wiring and plumbing and inner and outer panels which can be joined with other similarly constructed units to quickly and easily form a building wall.

Currently, the construction of a building with individual components delivered to a building site typically includes skilled carpenters who are relatively highly paid. Accordingly, it is an object of the present invention to provide a new and novel module for constructing a building which will decrease the skill level required to assemble the building modules utilized to form a building wall.

It is another object of the present invention to provide a multi-sided hollow building wall unit which can be stacked with a plurality of identical units to form a building wall.

It is still another object of the present invention to provide a multi-sided hollow building wall module including three panels each having a long edge and a short edge with the short edges being coupled together.

It is yet another object of the present invention to provide a triangularly shaped building wall unit having three angularly related panels having inner and outer surfaces and coupled together along their shorter edges to form a stackable unit which can be stacked with the exterior surfaces of the units in abutting relation.

The load bearing capabilities of a wall is always of importance. In many commercial building, steel roof systems are employed. The prior art studs typically comprise 2"×4" or 2"×6" wood or metal vertical load bearing unit. Metal studs typically include a C-shaped panel that has a tendency to twist about its longitudinal axis. Such C-shaped studs also bow, are hard to work with and are not highly fire rated. Such C-shaped studs have relatively low load bearing strength. Typically, masonry walls are required to provide sufficient load bearing characteristics to support such roof systems. Accordingly, it is yet another object of the present invention to provide a new and novel building wall unit which can be assembled with other identical units to increase the load bearing characteristics of a building wall constructed with individual assembled building components.

It is another object of the present invention to provide a modular building wall module which can be stacked with other similar building wall modules to provide a strong construction having a substantial load bearing characteristic.

It has been found, according to the present invention, that a wall constructed of triangularly shaped building wall units, that the vertical load bearing capabilities of the wall is greatly increased compared to conventional construction. Accordingly, it is another object of the present invention to provide a new and novel building wall unit for building a building wall which will have increased load bearing capabilities.

It is another object of the present invention to provide a triangularly shaped building wall unit which can be stacked atop other identically formed building wall units in a vertical plane to form a vertical building wall.

It is another object of the present invention to provide a triangularly shaped building wall unit which includes three panels having interior and exterior surfaces with the exterior surfaces of adjacent panels disposed in abutting relation.

It is still another object of the present invention to provide alignment members on each building unit for aiding the proper alignment of adjacent units in a wall built by unskilled workers.

Although the adjacent abutting surfaces of the triangularly shaped modules could be coupled together with screws, nails, rivets and other such fasteners to preclude their relative shifting, applicant's preferred embodiment includes a female recess in at least one of the three panels for receiving a complementally formed key for coupling to an adjacent module. Accordingly, it is an object of the present invention to provide a new and novel triangularly shaped building module of the type described which includes a new and novel keyway for receiving a key to preclude lateral shifting of stacked modules out of the plane of the wall.

Another object of the present invention is to provide a triangularly shaped building wall module of the type described which includes a female recess in at least one of the three legs and a complementally formed male projection in another of the three legs for being received in the female recess in the abutting leg of an adjacent stacked module to preclude relative lateral shifting of the modules stacked together to form a wall.

It is yet another object of the present invention to provide a stackable triangular building wall unit of the type described wherein the apparatus for precluding relative shifting of the units comprises an elongated slot extending between the short ends of at least one of the panels and a complementally formed elongate rib in the exterior face of another of the panels.

It is another object of the present invention to provide a new and novel method of constructing a building wall.

It is another object of the present invention to provide a new and novel method of constructing a building wall.

It is another object of the present invention to provide a new and novel building wall constructed with a plurality of triangularly shaped stackable modules with the outer faces of adjacent panels disposed in abutting relation.

Another object of the present invention is to provide a new and novel method of constructing a planar building wall with triangularly shaped building units stacked having exterior faces in abutting relation.

Still another object of the present invention is to provide a new and novel triangularly shaped stackable building wall unit of the type described which has increased strength and yet is aesthetically pleasing, durable and economical to assemble.

Another object of the present invention is to provide anew and novel triangular shaped prefabricated stackable building wall unit of the type described including prefabricated provisions for electrical, telecommunications, plumbing, heating, venting and air conditioning roughed in for future typical field applications.

It is another object of the present invention to provide a prefabricated triangular building wall finished component that can be stacked with other similar building wall finished components to form a finished planar building wall.

Various patents have disclosed multi-sided elongate beams which are not stacked to form a wall such as that disclosed in the following patents:

| U.S. Pat. No. | Date of Issue | Inventor |
|---|---|---|
| 2,082,792 | Jun. 7, 1937 | A. G. Dean |
| 2,192,994 | Mar. 19, 1947 | F. Weever |
| 5,379,567 | Jun. 10, 1995 | Michael Vahey |

-continued

| PCT International Publication No. | Date of Issue | Inventor |
|---|---|---|
| W088/05850 | Aug. 11, 1988 | Freeman, et al |

These and other objects of the present invention will become more readily apparent as the description thereof proceeds:

SUMMARY OF THE INVENTION

A stackable building wall module adapted to be stacked with a plurality of identical, building wall modules to form a planar wall, each module comprising: three sheets each including a pair of long edges and a pair of short edges which are substantially shorter than the long edges; each of the short edges of each of the sheets joined to one of the short edges of the two other sheets to form a triangular, stackable building wall unit which can be stacked with other units with the outside surfaces of the sheets of adjacent units in abutting relation.

BRIEF DESCRIPTION OF THE DRAWINGS

These and other advantage of the present invention may be more readily understood by reference to the accompanying drawings, which:

FIG. 1 is a perspective view of a triangularly shaped building wall module constructed according to a preferred embodiment of the invention;

FIG. 2 is a side elevational view thereof;

FIG. 3 is an enlarged sectional end view of the base leg, taken along the section line 3—3 of FIG. 2;

FIG. 3A is an enlarged sectional end view of one of the upwardly converging legs of the module, taken along the section line 3A—3A of FIG. 2;

FIG. 3B is an enlarged vertical sectional end view taken along the section line 3B—3B of FIG. 2;

DESCRIPTION OF PREFERRED EMBODIMENT

Figure 5:
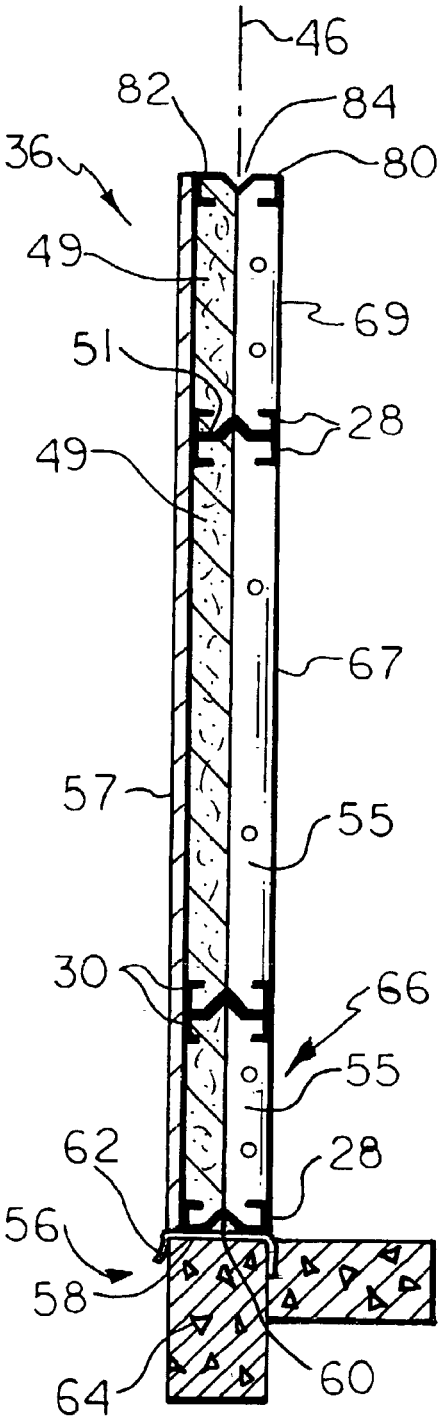
FIG. 5 is a vertical sectional end view, taken along the section line 5—5 of FIG. 4.
Figure 6:
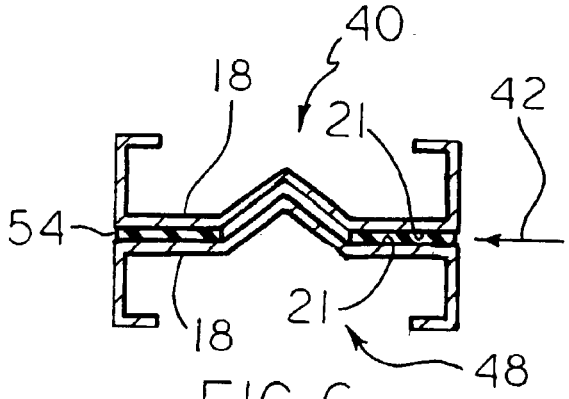
FIG. 6 is a greatly enlarged sectional end view illustrating one of the keyways for aligning and precluding relative shifting of adjacent stacked modular units, taken along the section line 6—6 of FIG. 5.

A triangularly shaped, stackable building wall unit or module, generally designated 10, constructed according to the present invention, includes three identically shaped panels 12, 14 and 16 which basically have the same outer dimensions and are arranged in a triangular formation and coupled together at the apices of the triangle as illustrated. Each of the panels 12, 14, and 16 is basically C-shaped in cross-section as illustrated in FIGS. 3, 5 and 6 and includes a rectangular sheet 18, which is generally planar, and a pair of spaced apart parallel long edges 20 and 22 spanned by parallel, spaced apart, laterally extending short edges 24 and 26 which are substantially shorter than the long edges 20 and 22 Each sheet 18 includes inner and outer surfaces 19 and 21, respectively, spanning the edges 20, 22, 24 and 26. The short edges 24 and 26 of each sheet 18 are welded or otherwise suitably fixed to the abutting short edges 26 and 24 of the adjacent sheets.

Figure 6A:
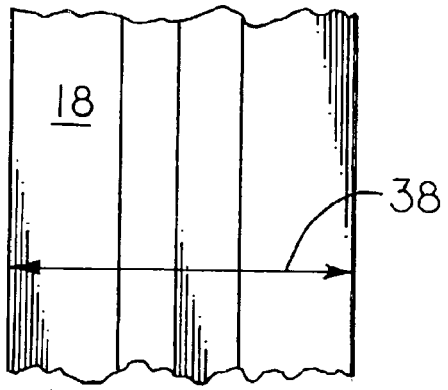
FIG. 6A is an under plan partial view illustrating a portion of the keyway trough in the base of one of the assembled modules, taken along the line section 6A—6A of FIG. 3.

Projecting transversely inwardly to the plane of each sheet 18 are elongate transverse inner and outer parallel flanges 28 and 30, integral with the long edges 20 and 22, respectively, including offset confronting terminal ends 32 and 34, respectively. As illustrated in FIG. 2, the overall height 31 of the module 10 between the outer surface 21 of base panel 16 and the upper outer edge of the junction of panels 12 and 14 is at least twice the width 38 (FIG. 6A) of each short panel edge 24 and 26. The transverse flanges 28 and 30 of each panel 12, 14 and 16 are in the planes of the transverse flanges 28 and 30, respectively, of the adjacent panels 12, 14 and 16.

Figure 4:
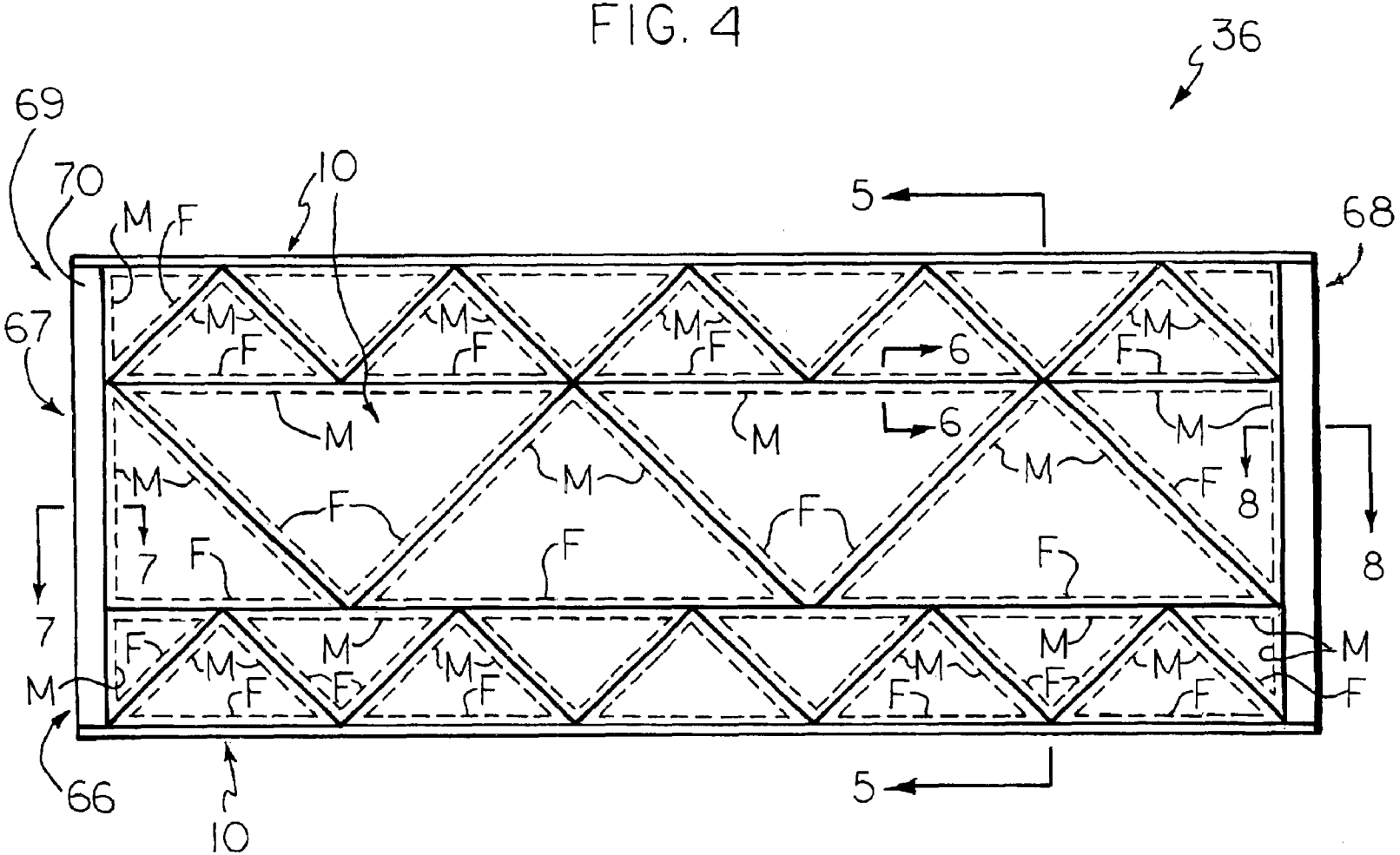
FIG. 4 is a side elevational view illustrating a plurality of triangularly shaped building modules of different vertical dimensions being stacked atop one another to form a prefabricated building wall section.

The building wall modules or units 10, which may vary in size, are stacked atop each other, as illustrated in FIG. 4, to complete a modular above grade wall section, generally designated 36, that can be prefabricated "in-house" and shipped to a remote building site.

The building wall module 10 may be constructed from various materials including aluminum, galvanized or stainless steel or integrally molded carbon fiber, plastic or graphite.

Aligning and stabilizing members, generally designated 40, are provided to assist in properly aligning the modules 10 with adjacent modules 10 and for inhibiting relative shifting of the modules 10 for example, in the direction of the arrow 42. The alignment and stabilizing members 40 include an elongate V-shaped female trough 46 formed in the exterior surface 21 in at least one of the panels 12, 14 and 16, such as that illustrated in the base 16 (FIGS. 1 and 3), and a complementally formed elongate male rib, generally designated 48, projecting outwardly from the exterior surface 21 of at least one of the other two legs of the triangle such as that illustrated in upwardly converging panels 12 and 14 in FIGS. 1 and 2. The embodiment illustrated in FIGS. 1–3 is particularly attractive for assembly into a wall section at the building site as the aligning and stabilizing members 40 facilitate accurate alignment by relatively unskilled workers.

It should be understood that all three of the panels 12, 14 and 16 could include either a male rib 48 or a female trough 46 depending upon the particular construction but typically most of the units would include two male ribs 48 and one female trough 46 or two female troughs 46 and one male rib 48. The troughs or keyways 46 in the various units 10 illustrated in FIG. 4 have been designated with a reference character "F" for a female trough 46 or an "M" for a male rib 48 to illustrate the relationship of the various assembled adjoining modules 10.

Each female trough 46 is defined by inwardly converging sheet portions 45 and 47 spanning the short edges 24 and 26 of panel 16 and each male rib 48 is defined by outwardly converging sheet portions 50 and 52 spanning the short edges 24 and 26 of panels 12 and 14. The shape of the rib 48 is formed complemental to the shape of the trough 46 and is readily receivable therein to easily and accurately orient the adjacent modules 10 when they are being assembled and to inhibit relative movement or lateral shifting thereof. The outwardly diverging sheet portions 50 and 52, which define the male rib 48, will guide along the inwardly converging sheet portions 45 and 47 defining the female trough 46 of an adjacent unit to allow an unskilled worker to quickly and easily assemble the units 10 into a building wall section 36, as illustrated in FIG. 4, lying in a vertical plane 44 (FIG. 5). When the modular wall section 36 is constructed as illustrated in FIG. 4, the cooperating male and female ribs and troughs 48 and 46, respectively, will inhibit relative lateral movement out of the vertical plane 44.

Each of the building units 10 can be prefabricated with a layer of heat transfer insulation 49 (FIG. 5) spanning the laterally outer portions 51, of the interior surfaces 19 of the sheets 18. A plurality of wire receiving apertures 53, which can vary in size, are provided through the laterally inner portions 55 of sheets 18 for receiving wire, plumbing pipes, or heating, ventilating and air conditioning ducts. If desired, the unit 10 can be prefabricated with hollow tubes (now shown) that can be disposed in the apertures 53 to receive either wire or plumbing. An exterior layer or sheathing, generally designated 57, is disposed on the outer sides of exterior flanges 28. The sheathing layer 57 may comprise exterior plywood and/or brick veneer or other exterior siding.

Figure 6B:
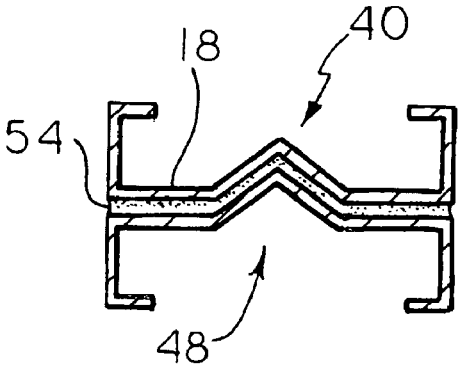
FIG. 6B is a greatly enlarged sectional end view similar to FIG. 6 illustrating adjacent panels of adjacent units bonded together with water proofing adhesive material disposed therebetween.

Before the units are stacked with the ribs 48 snugly received in the adjoining adjacent troughs 46, as illustrated in FIGS. 5 and 6, an asphalt based waterproof membrane 54 may be disposed between adjacent abutting interior surfaces 21 as illustrated in FIG. 6, to preclude the laterally inward passage of rain and/or air therebetween in the direction of the arrow 42. If desired, the abutting exterior surfaces 21 of abutting sheets 18 may be coated with an adhesive layer 54 (FIG. 6B) to bond the abutting sheets 18 of adjacent modules 10 together and preclude the lateral passage of rain and air therebetween. Such waterproof epoxy adhesive cement, or bonding agent may be that sold under the trademark SCOTCH-WELD® EPOXY ADHESIVE DT-90 by 3M, Minneapolis, Minn., or the acrylic adhesive for metals and plastics sold under the trademark "202" by the Lord Corporation, 2000 West Grand View Blvd., Erie, Pa. 16509. If desired, the abutting sheets 18 could be mechanically fastened with bolts and nuts, tech screws, or suitable welding.

The modules 10 can be stacked in the condition illustrated in FIG. 1 or prefabricated with pre-wiring, pre-plumbing, insulation, and the outer covering complete as illustrated in FIG. 5. If desired, an interior vertical panel, such as drywall, could also be mounted to the laterally inner filanges 28 of the legs 12, 14 and 16.

The modules 10 can be stacked atop a sill plate 56 (FIG. 5) mounted atop a building foundation 64. The elongate sill plate has a planar section 58 with an upwardly projecting, elongate male rib 60 thereon. The front outer edge of the sill plate 56 also includes a depending vertical, flange 62 disposed on the outside of the building foundation 64.

If desired, the wall section 36 is illustrated to include three vertically abutting rows 66, 67 and 69 of triangular modules 10. The base of each unit in the bottom row 66 of the building units 10 will have a female trough 46 for receiving the male rib 60 in the sill plate 62.

Figure 7:
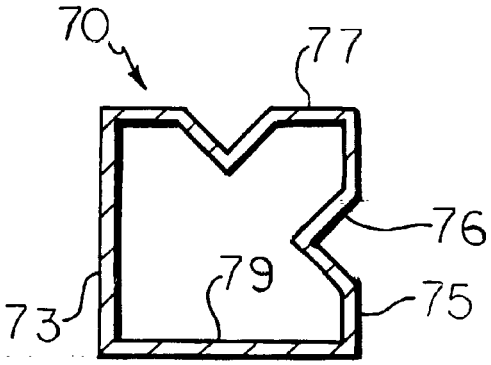
FIG. 7 is an enlarged sectional plan view, taken along the line section 7—7 of FIG. 4, illustrating a corner column only configured to receive the vertically aligned edges of the endmost modules of a pair of transversely disposed wall sections constructed according to the present invention.
Figure 8:
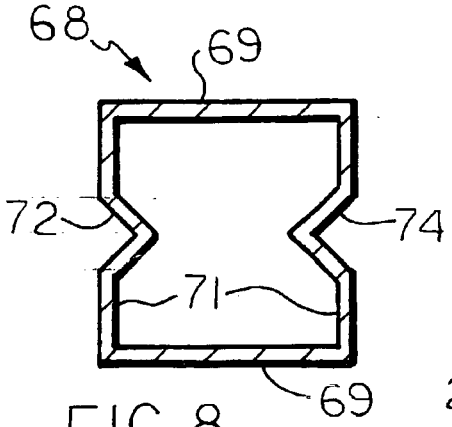
FIG. 8 is a vertical sectional view, taken along the section line 8—8 of FIG. 4, illustrating an end column typically utilized to couple the modular units illustrated in FIG. 4 to a similarly constructed in-line unit.

One end of the wall section 36, illustrated at the right side of FIG. 4, includes a vertically disposed, hollow end coupling column 68 (FIG. 8) for joining the wall section 36 to an adjacent in-line wall section 36 (not shown) at the building site. The opposite end of each modular prefabricated building wall section 36 can include a similar vertical column 68 but is illustrated as including a vertically disposed hollow corner coupling column 70 (FIG. 7) for coupling the wall section 36 to another transversely disposed wall section 36 (not shown) at the building site. It should be realized that a vertical in-line column 68 could likewisely be used instead of column 70 if each end is to be coupled to an adjacent in line wall section 36 in the plane 44. The in-line column 68, which is rectangular in cross-section, includes vertical side walls 69 spanned by vertical end walls 71 having vertically disposed troughs 72 and 74. The trough 72 receives the vertically aligned male projections or ribs 48 on the endmost units 10 located on the right hand edge of each of the units 10 illustrated in FIG. 4. The trough 74 would receive the upstanding, endmost male ribs 48 of an adjacent wall section 36 (not shown) to be coupled thereto.

The corner column 70 which is rectangular in cross-section, similarly includes vertical side walls 73 and 75 spanned by integral end walls 77 and 79. The innermost end wall 74 includes a vertical trough 76 for receiving the endmost vertically aligned male ribs 48 located at the left hand side of each of the modules 10 illustrated in FIG. 4. Only the sidewall 77 includes offset trough 78 which will be utilized to couple the wall section 36 to a second transverse wall section (not shown) which is transverse to plane 44 the wall section 36 illustrated in FIG. 4.

The wall section 36 includes a header, generally designated 80, spanning the upper ends of the columns 68 and 70. The header 80 includes (FIG. 5) a planar section 82 provided with a downwardly projecting male elongate rib 84 for receiving female troughs in the base 16 of each of the uppermost units 10 in the uppermost row 69 of units as illustrated in FIG. 4. If desired, rather than inserting waterproof membrane 54 between the adjacent units, a layer of waterproof cement 54 or acrylic adhesive (FIG. 6B), such as that sold under the trademarks SCOTCH-WELD® EPOXY ADHESIVE DT-90 by 3M, Minneapolis, Minn., or "202" by the Lord Corporation, may be utilized to preclude moisture and air from passing between the adjacent abutting surfaces 21 of adjacent units. Also, for certain uses and/or in certain climates, the waterproofing membrane 54 or 54A may be eliminated. If desired, the adjacent units may be mechanically fastened as outlined hereinbefore.

If the wall section 36 is prefabricated the columns 68 and 70, the header 80, and the sill plate 56 are welded or otherwise suitably coupled together "in-house" to facilitate shipping. If the modules 10 are individually shipped to the building site, the wall section 36 is assembled at the building site. If desired, an additional sell plate (not shown) and header could be mounted atop the foundation 64 and the header 80 (not shown) to span several prefabricated in-line wall sections 36.

The Method

A plurality of triangularly shaped stackable building wall modules or units, such as that illustrated at 10 in FIGS. 1–3, constructed and stacked together as illustrated in FIGS. 4 and 5 with the male ribs 48 received by the female troughs 46 of the adjacent abutting units 10. The modules 10 are stacked in the vertical plane 44 to provide an upstanding wall section 36.

The wall section 36 can be prefabricated in-house and shipped to the building site or shipped as individual components which are assembled at the building site as illustrated in FIGS. 4 and 5. Although only three different size modules 10 are illustrated in FIGS. 4 and 5, it should be realized that any number of various size triangular modules 10 could be assembled in various relationships depending upon the particular application.

The modules 10 can be prefabricated with the insulation layer 49, interior panels (not shown) exterior sheathing 57, and appropriate heating and ventilating ducts, and openings 53 for receiving wiring and plumbing pipes The exterior panels are selected and constructed so as to complementally mate with similar parts on an adjacent module 10 to provide internal joints that can be mudded and taped as in any conventional drywall construction. Likewise, the exterior sheathing 57 will complementally mate with the sheathing 57 to provide a smooth exterior building surface. The apertures 53 can be pre-engineered and located so as to be in alignment with the apertures 53 of an adjacent module 10.

The modules 10 are quickly and easily aligned in the plane 44 via the complementally formed troughs 46 and male ribs 60 which also inhibit relative shifting of the stacking modules 10. The outer abutting faces or surfaces 21 provide a relatively large bearing area which will support a substantial load.

The modules 10 can be cast or molded from carbon, plastic or graphite or assembled from individual panels 12, 14 and 16 which are welded at their abutting short ends 24 and 26.

Modified Embodiment

Figure 10:
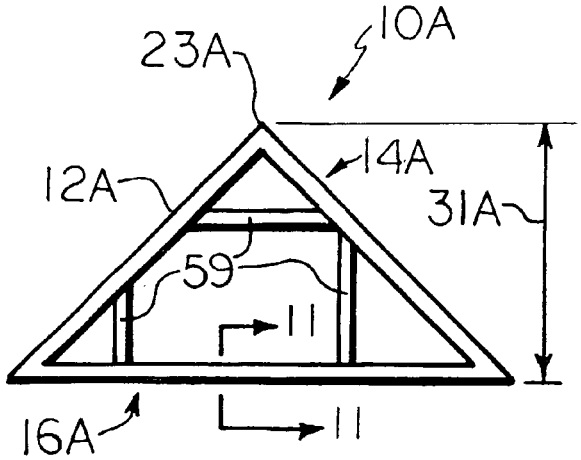
FIG. 10 is a side elevational view of the module illustrated in FIG. 9.
Figure 11:
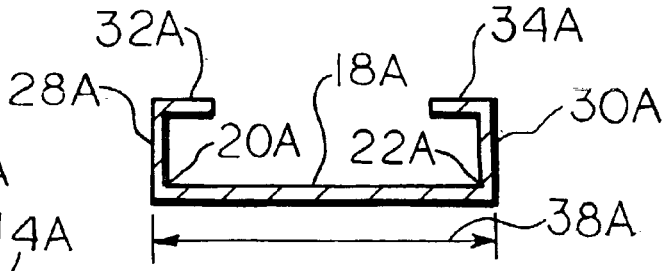
FIG. 11 is an enlarged sectional end view, taken along the section line 11—11 of the base leg of the module illustrated in FIG. 10.
Figure 9:
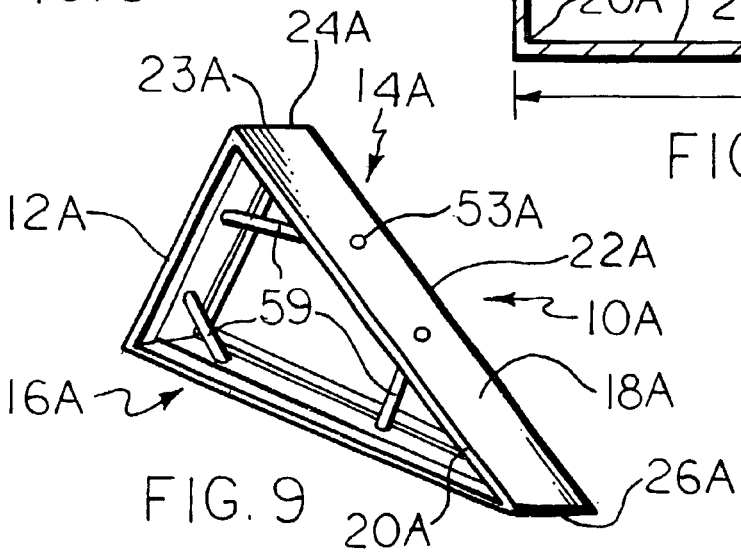
FIG. 9 is a perspective view illustrating another slightly modified triangular stackable building module constructed according to a slightly modified embodiment.
Figure 12:
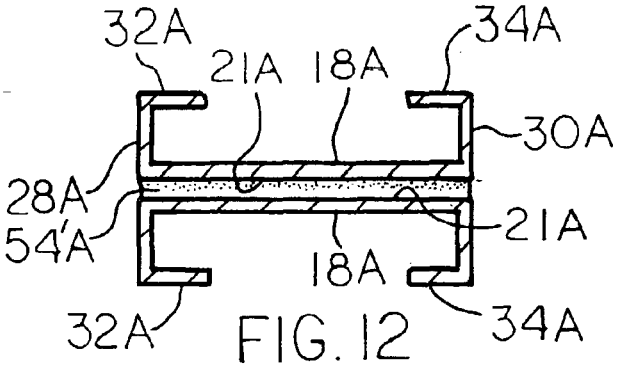
FIG. 12 is a greatly enlarged sectional end view, similar to FIG. 6, illustrating two of abutting panels of two of the adjacent modules, illustrated in FIGS. 9–11, stacked together to form a vertical wall.

Referring now more particularly to FIGS. 9, 10, 11, a slightly modified stabilizing triangularly shaped stackable building wall unit, generally designated 10A, is illustrated and generally similar parts will be referred to by generally similar reference characters followed by the letter subscript A. The module 10A differs from the module 10 in that the planar sheet 18A does not include the aligning and stabilizing members 40 which have the female trough 46 and the male rib 48 for aligning the modules and preventing lateral shifting. This embodiment is more likely to be assembled "inhouse" into a wall section which is then sent to a building site. The cross section of each individual sheet 18A is illustrated in FIG. 11 and the cross section of the abutting sheets 18A of adjacent modules 10A is illustrated in FIG. 12. If desired, an epoxy layer 54A is sprayed on the confronting exterior surfaces 21A to bond the adjacent units 10A together.

Figure 13:
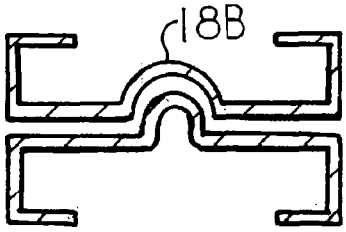
FIG. 13 is a sectional end view similar to FIG. 12 illustrating stacked modules having panels with a slightly modified cross section.
Figure 14:
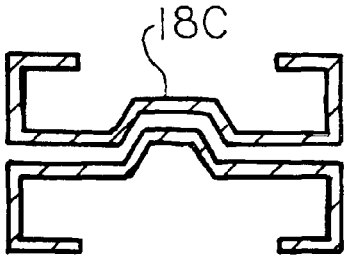
FIG. 14 is a sectional end view similar to FIG. 12 illustrating a further slightly modified cross section.
Figure 15:
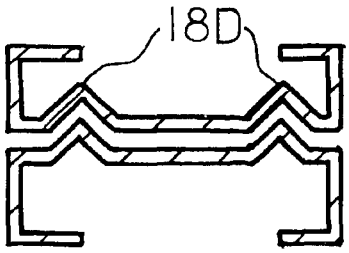
FIG. 15 is a sectional end view similar to FIG. 12 illustrating another slightly modified cross section.

It should be realized that the sheets 18 and 18A could be formed in cross sections such as that illustrated in FIGS. 13, 14, 15 to include curvilinear ribs and grooves 18B (FIG. 13), trapezoidally shaped ribs and grooves 18C (FIG. 14), or doubled V grooves and ribs 18D (FIG. 18D).

The module 10A further differs in that hollow tubes or pipes 59 are received by apertures 53A and welded or otherwise fixed to the sheets 18A of adjacent legs 12A, 14A and 16A. The pipes 59 can be of differing widths than that illustrated and aligned with the openings 53A and pipes 59 in an adjacent unit to provide wire, plumbing, or heating, ventilating and air conditioning ducts.

Another Modified Embodiment

Figure 16:
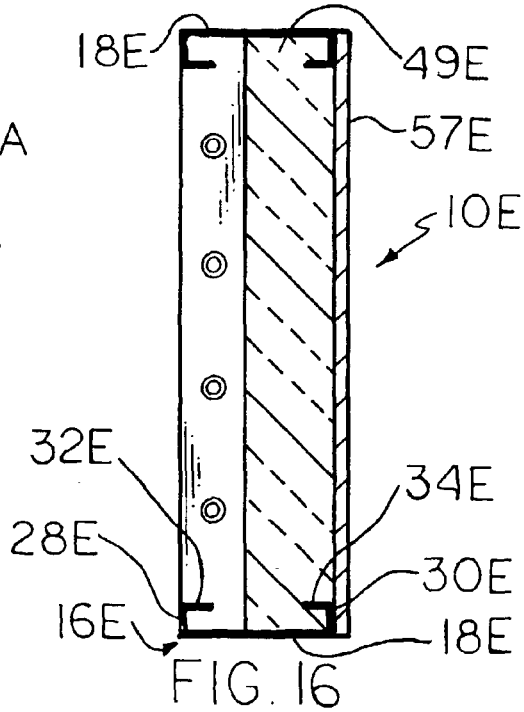
FIG. 16 is a sectional end view, similar to FIG. 3B, illustrating a further slightly modified above grade wall section which includes the module illustrated in FIGS. 10–12 including prefabricated rough in for plumbing, heating, ventilation, air conditioning and insulation and also includes a layer of exterior sheathing.

Referring now more particularly to FIG. 16, another slightly modified construction, generally designated 10E, is illustrated and generally similar parts will be identified by generally similar reference characters followed by the letter subscript E. The unit 10E differs in that each unit 18E includes a plurality of apertures, generally designated 53E, which receive hollow conduits 59E, to provide wiring, plumbing pipes or heating, ventilation and/or air conditioning ducts. A layer of heat insulation 49E is disposed along the outer portion 51E of the section 18E.

The conduits 59E will be received in the apertures 53E and will serve as conduits for the passage of wiring between the openings 53E and abutting members 18E.

Yet Another Embodiment

Figure 17:
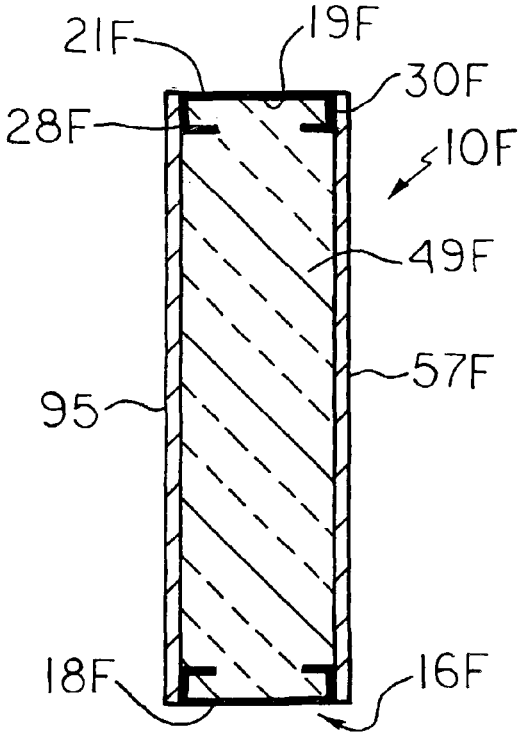
FIG. 17 is a vertical sectional end view, similar to FIG. 16, illustrating a below grade prefabricated slightly modified wall section for use in the construction of basements.

Referring now more particularly to FIG. 17, yet another slightly modified embodiment 10F. is illustrated and similar parts are identified by similar reference characters followed by the letter subscript F. The module 10F does not include keyways or apertures in the sheets 18F nor pipes spanning the sheets 18F. The unit 10F. is a below grade unit and includes a layer 49F of heat insulation which spans the entire interior surfaces 19E and substantially envelopes the entire inside of the unit 10F. The unit 10F is illustrated as including a layer of wallboard 95 mounted on the laterally inner flanges 28F.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A stackable building wall unit for stacking with a plurality of identical building wall units to form an upstanding building wall comprising three rectangular sheets, each including a pair of parallel spaced apart long edges, and a pair of parallel, spaced apart short edges substantially shorter than said long edges;

each of said short edges of each of said sheets joined to one of said short edges of the two other sheets to form a triangular, stackable building wall unit which can be stacked in abutting relation with an identical building wall unit;

at least one of said sheets including a female receptacle disposed between said long and short edges and at least one of said sheets including a complementally formed male projection disposed between said long and short edges for being received by the female receptacle in an identical building wall unit.

2. A stackable building wall unit for stacking with a plurality of identical building wall units to form an upstanding building wall comprising three rectangular sheets, each including a pair of parallel spaced apart long edges, and a pair of parallel, spaced apart short edges substantially shorter than said long edges;

each of said short edges of each of said sheets joined to one of said short edges of the two other sheets to form a triangular, stackable building wall unit which can be stacked in abutting relation with an identical building wall unit;

at least one of said sheets, including an elongate slot extending between said short edges thereof and at least another one of said sheets including a complementally formed male rib for being received in the elongate slot of an identical building wall.

3. The stackable building wall unit set forth in claim 2 wherein said long edges of each of said sheets includes a pair of transverse flanges.

4. The stackable building wall unit set forth in claim 3 wherein said pair of transverse flanges includes offset confronting terminal ends.

5. A stackable building wall unit for stacking with a plurality of identical building wall units to form an upstanding building wall comprising three rectangular sheets, each including a pair of parallel spaced apart long edges, a pair of parallel, spaced apart short edges substantially shorter than said long edges; and a pair of flanges integral with said long edges of each of said sheets and extending transversely to said sheet each of said short edges of each of said sheets joined to one of said short edges of the two other sheets to form a triangular, stackable building wall unit which can be stacked in abutting relation with an identical building wall unit.

6. The stackable building wall unit set forth in claim 5 wherein said flanges includes offset terminal ends disposed in confronting relation with each other.

7. The stackable building wall unit set forth in claim 6 wherein said flanges are parallel.

8. The stackable building wall unit set forth claim 7 wherein at least one of said sheets includes an elongate slot extending in a direction extending between said short edges of said one sheet; and at least another one of said sheets includes an elongate rib, complementally formed to said elongate slot and extending in a direction extending between said short edges of said another sheet, for being received in the elongate slot of an identically formed building wall unit stacked thereon.

9. A stackable building wall unit for stacking with a plurality of identical building wall units to form an upstanding building wall comprising three rectangular sheets, each including a pair of parallel spaced apart long edges, and a pair of parallel, spaced apart short edges substantially shorter than said long edges;

each of said short edges of each of said sheets joined to one of said short edges of the two other sheets to form a triangular, stackable building wall unit which can be stacked in abutting relation with an identical building wall unit;

said three sheets being integrally rigidly coupled in fixed relation with each other;

said long edges of each of said sheets including integral parallel transverse flanges.

10. The stackable building wall unit set forth in claim 9 wherein said transverse flanges on each sheet include offset terminal ends disposed in confronting relation with each other.

11. A stackable lightweight building wall module for stacking with a plurality of identical building wall modules to form a building wall, said building wall module comprising:

three rectangular planar panels each including a pair of laterally spaced apart long edges, and a pair of spaced apart short edges, substantially shorter than said long edges, joined to said short edges of the other two panels to form a triangular stackable building wall module which can be stacked in abutting relation with a plurality of identical building wall modules;

said long edges on each lateral side of said three panels lying in the same plane and being free of laterally outwardly projecting obstructions which would interfere with the mounting of transversely disposed building paneling in abutting relation with said long edges on each of said lateral sides.

12. A stackable lightweight building wall module for stacking with a plurality of identical building wall modules to form a building wall, said building wall module comprising:

three rectangular panels each including a pair of spaced apart long edges, and a pair of spaced apart short edges, substantially shorter than said long edges, joined to said short edges of the other two panels to form a triangular stackable building wall module which can be stacked in abutting relation with a plurality of identical building wall modules;

said panels each comprising a rectangular sheet having a pair of generally parallel, spaced apart long sheet edges;

a pair of generally parallel, spaced apart short sheet edges; and a pair of transversely disposed transverse flanges integral with each of said long edges.

13. The stackable building wall module set forth in claim 12 wherein said flanges are parallel.

14. The stackable building wall module set forth in claim 13 wherein said flanges include offset terminal ends disposed in confronting relation with each other.

15. The stackable building wall module set forth in claim 12 wherein each of said sheets includes a keyway for mating with a complementally formed keyway formed in one of the sheets of an identically formed unit.

16. The stackable building wall module set forth in claim 15 wherein said keyway in at least one of said sheets comprises an elongate female recess extending in a direction between said short sheet edges; and said keyway in at least one of said sheets comprises a complementally formed male projection to be received by said female recess of an identically building unit.

17. The stackable building wall module set forth in claim 15 wherein said keyway in at least one of said sheets comprises an elongate slot extending between said short sheet edges and said keyway in at least one of said sheets comprises an elongate projection extending between said short sheet edges for being received by said elongate slot in one of said panels of an abutting identically building unit.

18. The stackable building wall module set forth in claim 11 wherein said panels, each include an inner and an outer face for abutting the outer face of an identical building unit stacked thereon; and further including a layer of heat transfer insulation means spanning said inner faces of said panels.

19. The stackable building wall module set forth in claim 18 including a plurality of wiring receiving apertures in each of said panels for receiving wiring.

20. The stackable building wall module set forth in claim 19 including a plurality of hollow conduits received by said apertures and fixed to said panels for receiving wires therein.

21. The stackable building wall module set forth in claim 20 including a layer of exterior paneling, adapted to be exposed to the elements, fixed to said long edges at one side of said unit.

22. The stackable building wall module set forth in claim 21 including a layer of interior paneling fixed to said long edges at an opposite side of said unit opposite said one side.

23. The stackable building wall module set forth in claim 22 wherein said layer of exterior paneling comprises brick veneer.

24. A prefabricated modular building wall comprising:

a plurality of triangularly shaped, stackable building wall units each including three angularly disposed sheets each having inner and outer faces opposite ends each fixed to one of the opposite ends of the other two sheets to form a hollow triangle; and laterally spaced apart long side edges spanning said opposite ends, lying in a pair of laterally spaced apart parallel planes, and being free of laterally outwardly projecting obstructions which would otherwise interfere with the mounting of planar building paneling in abutting relation with said long lateral edges;

said plurality of units being stacked in a plane with said outer faces of each unit abutting the adjacent outer faces of the adjacent ones of said plurality of units.

25. The prefabricated modular building wall set forth in claim 24 including stabilizing means on each of said units between said opposite ends for precluding said units from shifting relative to each other.

26. The prefabricated modular building wall set forth in claim 25 wherein said stabilizing means includes a female recess in the outer face of at least one of said sheets of each of said units for receiving a complementally formed key.

27. The prefabricated modular building wall set forth in claim 25 wherein said stabilizing means comprises at least one female recess in the outer face of at least one of said sheets of each unit and a complementally formed male projection on the outer face of at least another of the other sheets of each unit for being detachably received in said female recess of an adjacent unit.

28. The prefabricated modular building wall set forth in claim 27 wherein each of said sheets includes a pair of spaced apart, parallel long edges and a pair of transverse, spaced apart short edges, substantially shorter than said long edges, at said opposite ends spanning said long edges; said short edges of each panel being joined to said short edges of the two other sheets.

29. The prefabricated modular building wall set forth in claim 28 wherein said female recess comprises an elongate slot extending in a direction between said short edges of said one sheet.

30. The prefabricated modular building wall set forth in claim 29 wherein said male projection comprises an elongate rib projection outwardly from said outer surface and formed complemental to said elongate slot.

31. The prefabricated modular building wall set forth in claim 30 wherein said slot spans said short ends of said one sheet and said elongate rib spans said short ends of said another sheet.

32. A prefabricated modular building wall comprising:

a plurality of triangularly shaped, stackable building wall units each including three angularly disposed sheets each having inner and outer faces and opposite ends each fixed to one of the opposite ends of the other two sheets to form a hollow triangle;

said plurality of units being stacked in a plane with said outer faces of each unit abutting the adjacent outer faces of the adjacent ones of said plurality of units;

each of said sheets including a pair of spaced apart, parallel long edges and a pair of transverse, spaced apart short edges, substantially shorter than said long edges, at said opposite ends spanning said long edges; said short edges of each panel being joined to said short edges of the two other sheets; and transverse flanges integrally coupled to said long edges of each of said sheets.

33. The prefabricated modular building wall set forth in claim 32 wherein said flanges are perpendicular to said sheets.

34. The prefabricated modular building wall set forth in claim 32 wherein said flanges on each of said sheets include offset terminal ends disposed in confronting relation with each other.

35. The prefabricated modular building wall set forth in claim 32 wherein said wall is rectangular.

36. The prefabricated modular building wall set forth in claim 24 wherein said wall is rectangular.

37. A building wall module for stacking with a plurality of identical building wall modules to form a building wall, said module including three sheets each having a pair of spaced apart long edges, a pair of spaced apart short edges, substantially shorter than said long edges, spanning said long edges, a pair of transverse flanges integral with said long edges of each of said sheets and extending transversely to said sheet;

said short edges of each of said sheets being fixed to said short edges of the other two sheets to form a triangularly shaped stackable building wall unit which can be stacked atop another identically formed building wall unit to form a wall.

38. The building wall module set forth in claim 37 including alignment and stabilizing means on at least one of said sheets for aligning the stacking of each of said units with another unit and for precluding said unit from shifting relative to said another unit after being stacked.

39. The building wall module set forth in claim 37 wherein said alignment and stabilizing means includes a female keyway recess in at least one of said sheets for receiving a complementally shaped key for preventing said one sheet from moving in a direction extending between said long edges.

40. The building wall module set forth in claim 38 wherein said alignment and stabilizing means includes a female recess in at least one of said sheets.

41. The building wall module set forth in claim 40 wherein said alignment and stabilizing means includes a male projection, formed complementally to said female recess, for being received by the female recess of an adjoining identical unit.

42. The building wall module set forth in claim 41 wherein said transverse flanges including offset opposing terminal ends.

43. The building wall module set forth in claim 41 wherein said female recess includes an elongate slot extending between said short edges and said male projection includes an elongate rib, formed complemental to said slot, extending between said short edge.

44. A stackable building wall module for stacking with a plurality of identical modules to form an upstanding wall comprising:

a multi-sided frame having a plurality of angularly related rectangular planar panels each including inner and outer faces, a pair of spaced apart parallel long edges, and a pair of spaced apart parallel short edges;

each of said short edges of each panel being joined to one of said short edges of the adjacent ones of said panels to form a multi-sided, stackable building wall unit which can be stacked with said outer faces of each unit abutting an outer face of another identical building wall unit to form an upstanding wall;

said long edges of said adjacent ones of said panels lying in the same plane and being free of obstructions for mounting transversely disposed planar building paneling in abutting relation with the long edges on each side of the building wall unit.

45. A triangular stackable building wall unit for stacking with a plurality of other identical building wall units to form an upstanding wall, said building wall unit comprising:

three panels each including:

laterally extending, longitudinally spaced-apart end edges of a predetermined length;

elongate, laterally spaced-apart, lateral edges of a predetermined greater length, substantially greater than said predetermined length, lying in a plane perpendicular to each of said panels; and inner and outer surfaces spanning said lateral edges and said longitudinally spaced end edges;

said panels being coupled together along said short edges to form a hollow triangular building unit which can be stacked with the plurality of identical units with said exterior surfaces of adjacent units in abutting relation;

said side edges on each lateral side of said triangular building wall unit lying in a transverse plane perpendicular to each of said panels and being free of obstructions for mounting transversely disposed planar building paneling in abutting relation therewith.

46. The stackable building wall unit set forth in claim 45 including alignment and stabilizing means on at least one of said sheets for aligning the stacking of the unit with another identical wall unit and for precluding said unit from shifting relative to said another identical unit after being stacked.

47. The stackable building wall unit set forth in claim 46 wherein said alignment and stabilizing means includes a female alignment and stabilizing recess in said exterior surface of at least one of said panels, and a complementally formed alignment and stabilizing projection, complemental to said female recess, in said exterior surface of at least another of said panels for being received in the female recess of an adjacent unit.

48. The stackable building wall unit set forth in claim 45 wherein the distance between the exterior surface of each panel and the junction of said end edges of the other two panels is at least twice said predetermined length of said end edges.

* * * * *